US005451336A

United States Patent [19]

Schwadtke et al.

[11] Patent Number: 5,451,336

[45] Date of Patent: Sep. 19, 1995

[54] PROCESS OF PREPARING A CONCENTRATED WATER-BASED LIQUID DETERGENT

[75] Inventors: Karl Schwadtke, Leverkusen; Eric Sung, Monheim, both of Germany

[73] Assignee: Henkel Kommanditgesellschaft auf Aktien, Duesseldorf, Germany

[21] Appl. No.: 211,854

[22] PCT Filed: Oct. 7, 1992

[86] PCT No.: PCT/EP92/02309

§ 371 Date: Apr. 15, 1994

§ 102(e) Date: Apr. 15, 1994

[87] PCT Pub. No.: WO93/08249

PCT Pub. Date: Apr. 29, 1993

[30] Foreign Application Priority Data

Oct. 15, 1991 [DE] Germany ..... 41 34 078.7

[51] Int. Cl.[6] ..... C11D 11/00; C11D 1/83; C11D 3/20

[52] U.S. Cl. ..... 252/89.1; 252/122; 252/173; 252/174.12; 252/174.17; 252/174.21; 252/550; 252/554; 252/DIG. 14

[58] Field of Search ..... 252/89.1, 95, 96, 104, 252/122, 173, 174.17, 174.21, 174.22, 550, 108, 554, 174.12, DIG. 14

[56] References Cited

U.S. PATENT DOCUMENTS

| | | | |
|---|---|---|---|
| 4,490,285 | 12/1984 | Kebanli | 252/551 |
| 4,595,526 | 6/1986 | Lai | 252/545 |
| 5,271,860 | 12/1993 | Schwadtke et al. | 252/96 |

FOREIGN PATENT DOCUMENTS

| | | |
|---|---|---|
| 0200263 | 11/1986 | European Pat. Off. . |
| 2186531 | 1/1974 | France . |
| 2316325 | 1/1977 | France . |
| 3942617 | 6/1991 | Germany . |
| 1527141 | 10/1978 | United Kingdom . |
| 9219711 | 11/1992 | WIPO . |

*Primary Examiner*—Paul Lieberman
*Assistant Examiner*—Lorna M. Douyon
*Attorney, Agent, or Firm*—Ernest G. Szoke; Wayne C. Jaeschke; Real J. Grandmaison

[57] ABSTRACT

A process for preparing a storage-stable and free-flowing concentrated water-based liquid detergent containing 15 to 35% by weight of anionic surfactant, 20 to 35% by weight of nonionic surfactant, and from 5 to 20% by weight of alcohol. A dilute sodium hydroxide solution is heated to 70° to 85° C. to which is added a fatty acid and the alcohol. The mixture is stirred at 350 to 500 r.p.m. for 3 to 10 minutes. The anionic surfactant and nonionic surfactant are added to the mixture and stirred at 150 to 350 r.p.m.

9 Claims, No Drawings

PROCESS OF PREPARING A CONCENTRATED WATER-BASED LIQUID DETERGENT

BACKGROUND OF THE INVENTION

FIELD OF THE INVENTION

This invention relates to a homogeneous, concentrated water-based liquid detergent, to a process for its production and to its use for the manual and machine washing of fabrics.

Water-based liquid detergents which contain a mixture of anionic and typical nonionic surfactants and in which the nonionic surfactant content, based on the liquid detergent as a whole, is 20% by weight or more, generally lack homogeneity to the extent that the liquid detergent undergoes phase separation, for example separation into two clear liquid phases or the flocculation of a solid. This phase separation either occurs directly during production, during storage for several weeks (inadequate stability in storage) or on dilution with water. Another disadvantage is that liquid detergents of this type often show such high viscosities that they can no longer flow without the application of external shear forces.

It has now been found that it is possible to produce concentrated water-based liquid detergents containing at least 20% by weight of nonionic surfactants which do not have any of the disadvantages mentioned above.

DESCRIPTION OF THE INVENTION

In a first embodiment, therefore, the present invention relates to a concentrated water-based liquid detergent containing 30 to 60% by weight of anionic and nonionic surfactants, with the proviso that the nonionic surfactant content of the detergent is 20 to 35% by weight, based on the detergent as a whole, and the detergent contains monohydric and/or polyhydric alcohols containing 1 to 6 carbon atoms in quantities of 5 to 20% by weight, based on the detergent as a whole, as organic solvents and flows under the sole effect of gravity without any need for other shear forces to be applied.

The concentrated water-based liquid detergents preferably contain at least 35% by weight and more preferably between 40 and 60% by weight and, with particular advantage, between 45 and 58% by weight of surfactants. The detergents are homogeneous, stable in storage (stability test over at least 3 months both at room temperature and at extremely low temperatures of 5° C. and 40° C.) and do not undergo phase separation, even on dilution with water. They may be used manually and in machines either in concentrated form or, if required by the consumer, in dilute form. Thus, the consumer may either use the concentrated detergent directly in a quantity smaller than the quantity required in the case of commercial non-concentrated liquid detergents or, alternatively, may transfer the concentrated detergent to a bottle of larger volume, for example with twice the volume, fill up the bottle with water to the required dilution of the detergent and use the now dilute detergent, which is also stable in storage, in the quantities in which conventional, non-concentrated water-based liquid detergents are normally used. The liquid concentrates are preferably mixed with water in a ratio of 1:2 to 1:1. In machine washing, the concentrated liquid detergent is dispensed either via the dispensing compartment of the washing machine or via a commercial, external dispenser, for example in the form of a dispensing ball.

The nonionic surfactant content of the detergent is preferably 22 to 32% by weight and more preferably 25 to 30% by weight. The nonionic surfactants used are preferably adducts of on average 1 to 10 moles of ethylene oxide with primary $C_{12-18}$ fatty alcohols and mixtures thereof, such as coconut oil fatty alcohol, tallow fatty alcohol or oleyl alcohol, or with primary alcohols (oxoalcohols) methyl-branched in the 2-position. Particularly suitable adducts are $C_{12-14}$ alcohols . 3 EO or 4 EO, $C_{13-15}$ alcohols . 3, 5 or 7 EO, $C_{12-18}$ alcohols . 3, 5 or 7 EO and mixtures thereof, such as mixtures of $C_{12-14}$ alcohol . 3 EO and $C_{12-18}$ alcohol . 5 EO. The concentrated liquid detergents preferably contain 21 to 30% by weight and, more particularly, 22 to 28% by weight of ethoxylated nonionic surfactants. The detergents preferably contain as further nonionic surfactants alkyl glucosides corresponding to the general formula $RO(G)_x$, where R is a primary linear or 2-methyl-branched aliphatic radical containing 8 to 22 and preferably 12 to 18 carbon atoms and G stands for a glucose unit. The degree of oligomerization x, which indicates the distribution of monoglucosides and oligoglucosides, is a number of 1 to 10 and preferably a number of 1.2 to 1.4. The concentrated water-based liquid detergents may preferably contain 1 to 5% by weight of alkyl glucoside.

Suitable anionic surfactants are the known sulfates, sulfonates and soaps. The anionic surfactant content of the detergents is preferably 15 to 35% by weight and more preferably 18 to 31% by weight. Preferred anionic surfactants are fatty alkyl sulfates, alkanesulfonates, saturated and/or unsaturated soaps and, in particular, mixtures thereof, such as mixtures of fatty alkyl sulfate and soap, mixtures of alkanesulfonate and soap and mixtures fatty alkyl sulfate, alkanesulfonate and soap.

Suitable fatty alkyl sulfates are the sulfuric acid monoesters of $C_{12-18}$ fatty alcohols, such as lauryl, myristyl or cetyl alcohol, and the fatty alcohol mixtures obtained from coconut oil, palm oil and palm kernel oil and also tallow which may additionally contain unsaturated alcohols, for example oleyl alcohol. Mixtures in which 50 to 70% by weight of the alkyl radicals contain 12 carbon atoms, 18 to 30% by weight 14 carbon atoms, 5 to 15% by weight 16 carbon atoms, less than 3% by weight 10 carbon atoms and less than 10% by weight 18 carbon atoms are preferably used. The fatty alkyl sulfate content of the detergents is preferably 2 to 10% by weight and more preferably 2 to 5% by weight.

The readily biodegradable alkanesulfonates are obtained from $C_{12-18}$ alkanes, for example by sulfochlorination or sulfoxidation and subsequent hydrolysis or neutralization. The sulfonate group is statistically distributed over the carbon chain as a whole, the secondary alkanesulfonates predominating. The concentrated water-based liquid detergents preferably contain 8 to 20% by weight and more preferably 10 to 16% by weight of alkanesulfonate.

Other suitable anionic surfactants are in particular soaps, preferably in quantities of 8 to 20% by weight and more preferably in quantities of 10 to 18% by weight. Suitable saturated fatty acid soaps are, for example, the salts of lauric acid, myristic acid, palmitic acid or stearic acid and, in particular, soap mixtures derived from natural fatty acids, for example coconut oil, palm kernel oil or tallow fatty acids. Soap mixtures of which 50 to 100% by weight consist of saturated $C_{12-18}$ fatty acid soaps and 0 to 50% by weight of oleic acid soap are particularly preferred.

The anionic surfactants may be present in the form of their sodium, potassium or ammonium salts and in form of soluble salts of organic bases, such as mono-, di- or triethanolamine. The anionic surfactants are preferably present in the form of their sodium salts and/or potassium salts, preferably their sodium salts.

The concentrated and homogeneous liquid detergents contain water and monohydric and/or polyhydric alcohols preferably containing 2 to 4 carbon atoms as solvents. Preferred alcohols are ethanol, propanol, 1,2-propanediol, glycerol or mixtures thereof. The detergents preferably contain 20 to 50% by weight, more preferably 25 to 45% by weight and, with particular advantage, 28 to 40% by weight of water. The monohydric and/or polyhydric alcohol content of the detergents is preferably 5 to 17% by weight. In a particularly preferred embodiment, the detergents contain 7 to 15% by weight of a mixture of ethanol and glycerol in any ratio.

The pH value of the concentrated detergents according to the invention is generally in the range from 7 to 10.5, preferably in the range from 7 to 9.5 and more preferably in the range from 7 to 8.5. Relatively high pH values, for example above 9, may be adjusted by the use of small quantities of sodium hydroxide or alkaline salts, such as sodium carbonate or sodium silicate. The liquid detergents are clear and are flowable and can be poured under the sole effect of gravity without any need for other shear forces to be applied. Their viscosity is generally below 1,000 mPas (Brookfield viscosimeter, spindle 1, 20 revolutions per minute, 20° C.). The viscosity of the detergents is preferably in the range from 150 to 900 mPas and more preferably in the range from 150 to 500 mPas.

The detergents are preferably free from water-soluble and water-insoluble builders. In a particularly preferred embodiment, they do not contain the (co)polymeric polycarboxylates known as co-builders, for example homopolymers or copolymers of acrylic acid or maleic acid.

In addition to the ingredients mentioned above, however, the detergents may contain known additives of the type typically used in detergents, for example salts of citric acid, salts of polyphosphonic acids, optical brighteners, enzymes, enzyme stabilizers, small quantities of neutral filling salts and also dyes and fragrances, opacifiers and pearlescers.

Preferred salts of polyphosphonic acids optionally present are the neutrally reacting sodium salts of, for example, 1-hydroxyethane-1,1-diphosphonate and diethylenetriamine pentamethylene phosphonate which are used in quantities of 0.1 to 1.5% by weight. The total phosphorus content of the detergents is preferably less than 0.5% by weight.

Suitable enzymes are those from the class of proteases, lipases, amylases, cellulases and mixtures thereof. The enzyme content may be from 0.2 to 2% by weight.

In addition to the monohydric and polyhydric alcohols, the detergents may contain other enzyme stabilizers. For example, sodium formate may be used in a quantity of 0.5 to 1% by weight. Proteases stabilized with soluble calcium salts (calcium content preferably about 1.2% by weight, based on the enzyme) may also be used. However, it is of particular advantage to use boron compounds, for example boric acid, boron oxide, borax and other alkali metal borates, such as salts of orthoboric acid ($H_3BO_3$), metaboric acid ($HBO_2$) and pyroboric acid (tetraboric acid $H_2B_4O_7$).

Where the detergents are used in washing machines, it can be of advantage to add typical foam inhibitors. Suitable non-surface-active foam inhibitors are, for example, organopolysiloxanes and mixtures thereof with microfine, optionally silanized silica and also paraffins, waxes, microcrystalline waxes and mixtures thereof with silanized silica. Mixtures of various foam inhibitors, for example of silicones, paraffins or waxes, may also be used with advantage.

In one preferred embodiment, the detergents contain 2 to 8% by weight of fatty alkyl sulfate, 12 to 18% by weight of soaps consisting of the salt of oleic acid, the salt of saturated $C_{12-16}$ fatty acids or mixtures thereof in a ratio by weight of oleate to saturated soap of 2:1 to 1:2, 21 to 30% by weight of ethoxylated fatty alcohol, 1 to 5% by weight of fatty alkyl glucoside, 8 to 12% by weight of ethanol and/or glycerol, 0.5 to 1% by weight of protease and 0.2 to 1% by weight of citric acid salt (based on the free acid).

In another preferred embodiment, the detergents contain 2 to 5% by weight of fatty alkyl sulfate, 8 to 16% by weight of alkanesulfonate, 10 to 17% by weight of saturated soap or a soap mixture of saturated and unsaturated fatty acid soaps, 22 to 28% by weight of ethoxylated fatty alcohols, 1 to 5% by weight of fatty alkyl glucoside, 10 to 15% by weight of ethanol and/or glycerol and other additives, more particularly enzymes, salts of citric acid, dyes and fragrances, pearlescers and optionally up to 1% by weight of phosphonate.

In another embodiment, the present invention relates to a process for the production of the concentrated water-based liquid detergent in which soap and the polyhydric alcohol optionally present, more particularly glycerol, are added to a heated, dilute sodium hydroxide solution, which has preferably been heated to 70° to 85° C., and intensively mixed for about 3 to 10 minutes at a high rotational speed of the stirrer, more particularly at 350 to 500 revolutions per minute (r.p.m.). The other ingredients are then added at a slower rotational speed of the stirrer, preferably at 150 to at most 300 r.p.m. The remaining surfactants except for the alkanesulfonate optionally present are added at the same time in preheated, liquid, molten or solvent form, preferably in a form heated to between 65° and 90° C. and more particularly to between 75° and 85° C. Intensive stirring of the mixture is continued. Ethanol is preferably added at a temperature of 40° to 55° C. and more preferably at a temperature of 48° to 55° C. After further cooling to room temperature, the remaining ingredients, more particularly the temperature-sensitive ingredients, for example enzyme, dyes and fragrances, are added.

EXAMPLES

The liquid detergents D1 and D2 according to the invention had the following composition (in % by weight):

| | D1 | D2 |
|---|---|---|
| $C_{12-14}$ Fatty alkyl sulfate, sodium salt | 5.0 | 2.0 |
| Alkane sulfonate, sodium salt (100% active substance; used as Hostapur SAS 93, a product of Hoechst, Fed. Republic of Germany) | — | 12.0 |
| Lauric acid | 8.0 | 7.0 |

-continued

| | D1 | D2 |
|---|---|---|
| Oleic acid | 6.0 | 7.0 |
| $C_{12-18}$ Fatty alcohol with on average 7 EO | 27.0 | 25.0 |
| $C_{12-14}$ Alkyl glycoside with x = 1.4 | 3.0 | 3.0 |
| Sodium hydroxide | 2.2 | 2.2 |
| Ethanol | 5.0 | 7.0 |
| Glycerol | 5.0 | 5.0 |
| Citric acid | 0.5 | 0.5 |
| Protease | 0.8 | 0.8 |
| Amylase | 0.08 | 0.08 |
| Water, dyes and fragrances, pearlescers | Balance to 100% by weight | |
| pH | 7.9 | 8.1 |

The detergents were produced by initially heating a mixture of demineralized water and sodium hydroxide to 80° C. This was followed by addition and neutralization of the fatty acids and by addition of the glycerol. The mixture was stirred for 5 minutes at 400 r.p.m. and then at 200 r.p.m. The other ingredients, more particularly the citric acid and the pearlescer, were then added. Before any other components were added, the mixture was stirred until a homogeneous mixture was obtained. The fatty alkyl sulfate, the alkyl glucoside and the ethoxylated fatty alcohol were then successively added in a form heated to 80° C. By contrast, the alkanesulfonate was added in a non-preheated form. After cooling to 50° C., ethanol was added. After further cooling to room temperature, the enzymes and also the dyes and fragrances were added.

The homogeneous detergents D1 and D2 according to the invention were stable in storage for 3 months both at room temperature and at 5° C. and 40° C. (stability test terminated after 3 months). The viscosity (Brookfield viscosimeter, 20° C., spindle 1, 20 r.p.m.) was 330 mPas for D1 and 160 mPas for D2. The detergents could be diluted with water in any ratio without any phase separation occurring over a period of 4 weeks (stability test terminated after 4 weeks).

Comparison tests with D1, in which the surfactants were added in cold, non-preheated form and/or the ethanol was added at room temperature, produced either inhomogeneous products or could no longer be made up as liquid detergents because the viscosity of the mixture increased to such an extent that it could not flow without the application of shear forces (paste formation).

We claim:

1. The process of preparing a concentrated water-based liquid detergent consisting essentially of from 15 to 35% by weight of anionic surfactant, from 20 to 35% by weight of ethoxylated fatty alcohol, optionally from 1 to 5% by weight of alkyl glucoside, and from 5 to 20% by weight of a monohydric and polyhydric alcohol having 1 to 6 carbon atoms, comprising heating a dilute sodium hydroxide solution to 70° to 85° C. and adding a soap-forming amount of fatty acid and said polyhydric alcohol to said solution, mixing the resultant mixture at from 350 to 500 r.p.m. for about 3 to 10 minutes, heating said anionic surfactant other than alkanesulfonates, said ethoxylated fatty alcohol and said alkyl glucoside, if present, to 65° to 90° C. and adding them to the resultant mixture, mixing the resultant mixture at from 150 to 300 r.p.m., and then adding said monohydric alcohol to said mixture at a temperature ranging from 40° to 55° C.

2. A process as in claim 1 wherein said ethoxylated fatty alcohol comprises an adduct of 1 to 10 moles of ethylene oxide with primary $C_{12}$—$C_{18}$ fatty alcohols.

3. A process as in claim 1 wherein said anionic surfactant is selected from the group consisting of fatty alkyl sulfates, alkane sulfonates, and soaps.

4. A process as in claim 1 wherein said monohydric alcohol is selected from the group consisting of ethanol, propanel, and minutes thereof, and said polyhydric alcohol is selected from the group consisting of 1,2-propane diol, glycerol, and mixtures thereof.

5. A process as in claim 1 wherein said liquid detergent contains 20 to 50% by weight of water, based on the weight of said liquid detergent.

6. A process as in claim 1 wherein said liquid detergent has a pH from 7 to 10.5.

7. A process as in claim 1 wherein said liquid detergent has a viscosity of below 1,000 mPas measured at 20° C. with a Brookfield viscosimeter, spindle no. 1, at 20 r.p.m.

8. A process as in claim 1 wherein said monohydric alcohol is ethanol.

9. A process as in claim 1 including cooling said mixture to room temperature, and adding thereto an enzyme, dye and fragrance.

* * * * *